US006635836B1

(12) United States Patent
Beauchamp

(10) Patent No.: US 6,635,836 B1
(45) Date of Patent: Oct. 21, 2003

(54) HOUSING CONTAINED FLUID FLOW SWITCH AND INDICATOR

(75) Inventor: Shaun M. Beauchamp, Manitowoc, WI (US)

(73) Assignee: Oil-Rite Corporation, Manitowoc, WI (US)

( * ) Notice: Subject to any disclaimer, the term of this patent is extended or adjusted under 35 U.S.C. 154(b) by 0 days.

(21) Appl. No.: 10/340,430

(22) Filed: Jan. 10, 2003

Related U.S. Application Data

(60) Provisional application No. 60/373,729, filed on Apr. 18, 2002.

(51) Int. Cl.[7] ..... H01H 35/24; H01H 11/00

(52) U.S. Cl. ..... 200/81.9 R; 200/317; 29/622

(58) Field of Search ..... 200/60, 81 R, 200/81.4, 81.5, 81.6, 81.7, 81.8, 81.9 R, 82 R, 308–317

(56) References Cited

U.S. PATENT DOCUMENTS

| | | | | |
|---|---|---|---|---|
| 1,306,154 A | | 6/1919 | Leitman | |
| 1,675,849 A | | 7/1928 | Fultz | |
| 2,039,717 A | | 5/1936 | Hueber et al. | |
| 2,698,887 A | | 1/1955 | Shaw | |
| 2,734,960 A | | 2/1956 | Reynolds | |
| 3,394,345 A | | 7/1968 | Thomas | |
| 3,551,620 A | | 12/1970 | Hoover | |
| 3,704,458 A | * | 11/1972 | Buchanan et al. | 200/81.9 R X |
| 3,798,692 A | * | 3/1974 | Madeley | 200/83 N X |
| 3,939,457 A | * | 2/1976 | Nelson | 340/607 |
| 4,181,835 A | | 1/1980 | Stadler et al. | |
| 4,292,840 A | * | 10/1981 | Nguyen | 200/81.8 X |
| 4,377,090 A | | 3/1983 | Seulen | |
| 4,423,751 A | | 1/1984 | Roettgen | |
| 4,443,671 A | | 4/1984 | Hinds | |
| 4,620,073 A | | 10/1986 | Yokota et al. | |
| 6,338,279 B1 | | 1/2002 | Tsataros | |

FOREIGN PATENT DOCUMENTS

| | | |
|---|---|---|
| GB | 553583 | 5/1943 |
| GB | 608669 | 9/1948 |

* cited by examiner

*Primary Examiner*—J. R. Scott
(74) *Attorney, Agent, or Firm*—Ryan Kromholz & Manion, S.C.

(57) ABSTRACT

A fluid flow indicator including a disk and spring assembly positioned within a fluid conduit whereby the pulsing force a fluid input biases the disk and spring against an electrical contact thereby completing an electrical circuit and illuminating a visual indicator.

10 Claims, 3 Drawing Sheets

HOUSING CONTAINED FLUID FLOW SWITCH AND INDICATOR

PRIORITY APPLICATION

This application claims the benefit of prior application Ser. No. 60/373,729, filed Apr. 18, 2002.

BACKGROUND OF THE INVENTION

The present invention relates to fluid flow indicators and specifically to an indicator that provides a visual indication of a pulsating fluid flow.

It is common to include lubrication devices in the design of industrial machinery. Specifically, lubricant may be provided to bearings, journals, chains, sprockets and other machine components. The lubrication devices may include pumps that meter lubricant to the machine at a predetermined level or at predetermined time intervals. The lubricant is typically stored in a lubricant supply source, such as a tank and then delivered by a conduit to a pump. The amount of lubricant in the tank or other supply source may be monitored by a sight gage, float gage, or similar device. A second conduit directs the lubricant from the pump either to the machine or to a lubricant manifold where it may be subsequently sent to multiple locations on the machine.

In most applications if the supply tank is full, it is assumed that lubricant is being delivered to the machine component. However, if the supply conduit breaks or the pump malfunctions, there is typically no indication of lack of lubricant flow until a machine component fails. There is a need for a device that monitors fluid flow downstream of the lubricant pump and provides a confirming signal that fluid is flowing from the pump outlet.

SUMMARY OF THE INVENTION

The present invention relates to a device for monitoring fluid flow from a pressurized fluid output, such as the output from a pump or metering device. The fluid flow indictor activates an indicator, such as a light emitting diode, in response to a predetermined increase in the pressure of the fluid flowing through a conduit. Specifically, a pulse is generated by an increase in fluid pressure across a specified plane within a cavity or chamber, followed by a pressure drop across the plane, and then equalization of the pressure across the plane. This pulse translates into instantaneous force acting on the plane. A disk is placed in the plane causing the pulse to be amplified. The disk is then unidirectionally linearly dampened with a conical spring, resulting in displacement of the disk along a linear axis from an initial position to a second position.

The invention utilizes a power supply, such as one or more button cell batteries, and a visual indicator, such as a light-emitting diode (LED), in a closed loop circuit with the spring and the disk. The spring and disk assembly functions as switch, closing the circuit when the fluid pressure reaches a predetermined level. This results in illumination of the indicator. Thus, as pressurized fluid flows through the conduit, the device allows for a continuous visual monitoring of the fluid flow in a display on the LED.

DETAILED DESCRIPTION

Figure 1:
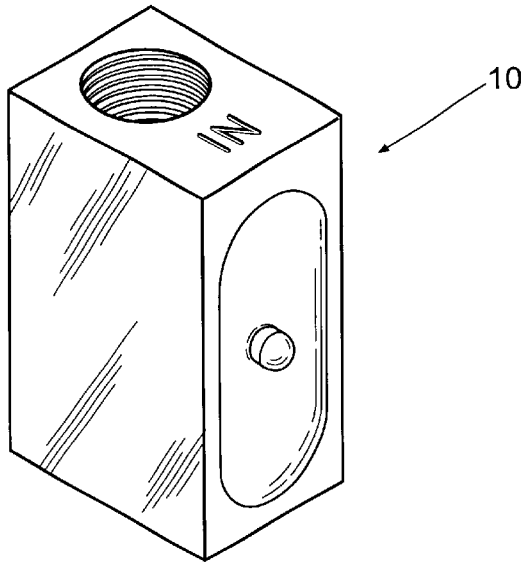
FIG. 1 is a perspective view of the fluid flow indicator of the present invention.

Referring to the drawings, the fluid flow sensor assembly of the present invention is designated generally by the reference numeral 10. A housing 11 has a longitudinal through bore 12 extending from the housing 11 top surface 13 to its bottom surface 15. A pair of counter bores 23 is formed inwardly from both the top surface 13 and the bottom surface 15. The counter bore 23 at the top surface is preferably provided at its inlet end with threads 17 engageable with a threaded pipe nipple 20. The counter bore 23 at the lower end of the bore 12 is provided with threads 18 engageable with an outlet pipe nipple 21. (See FIGS. 4 and 5.) The nipples 20 and 21 are threaded to a conduit 14 located in a fluid flow line emanating from a tank of fluid to be sensed by the sensor assembly 10 (not shown).

An elongated milled slot 26 is formed in the front face 16 of the housing 11. Two large counter-bores 30 and 31 are sized to each hold a pair of batteries 19*a* and 19*b*, and are further configured to define the slot 26. The respective axes of the counter-bores 30, 31 preferably lie substantially perpendicular to the axis of the longitudinal bore 12.

Figure 2:
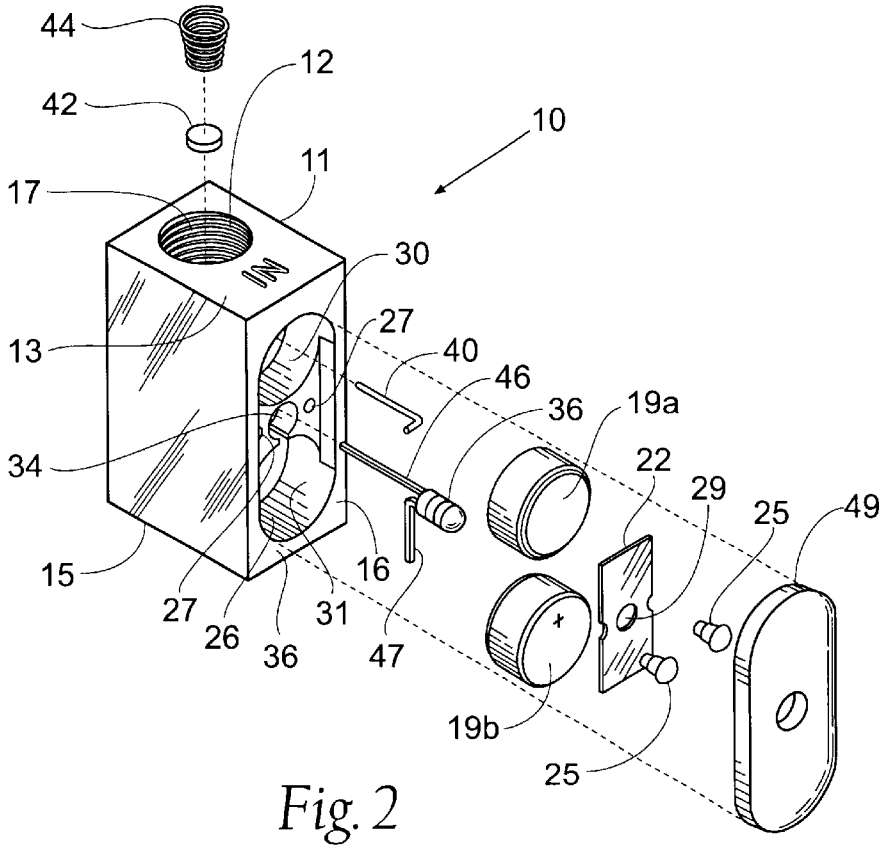
FIG. 2 is an exploded perspective view of the fluid flow indicator.
Figure 3:
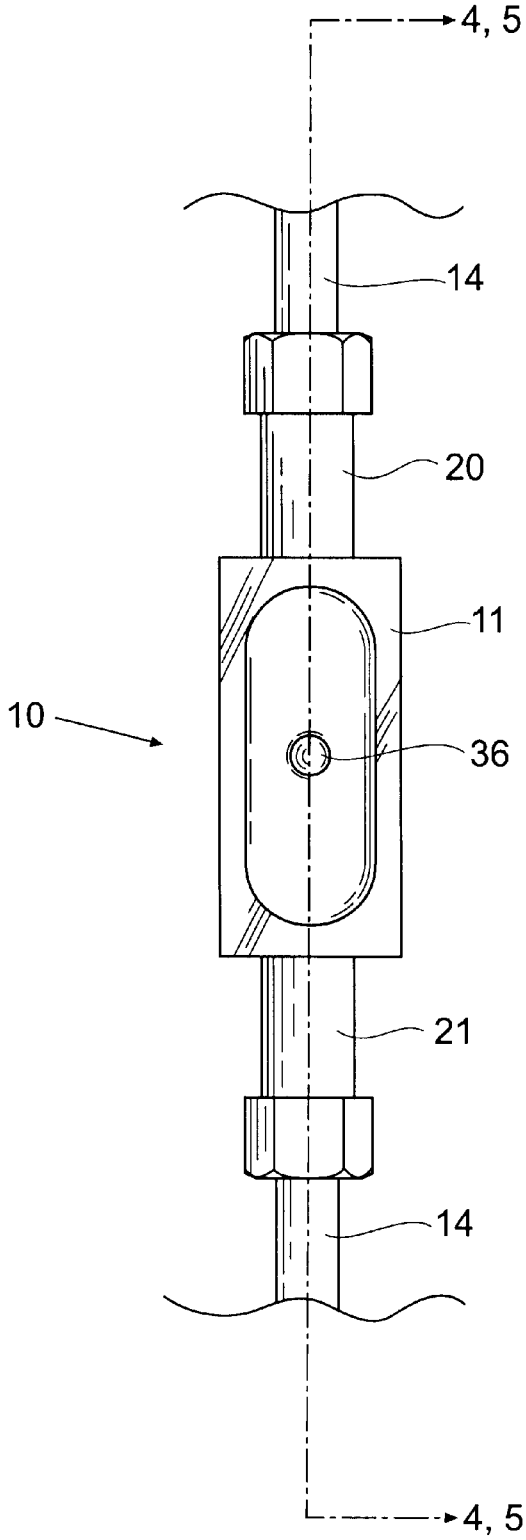
FIG. 3 is a side elevational view of the indicator assembly installed in a typical fluid flow circuit.

Referring next to FIG. 2, a smaller diameter counter-bore 34 is formed parallel to and between the aforementioned larger counter-bores 30, 31 and is arranged to retain a light-emitting diode (LED) 36. Within the uppermost larger counter-bore 30, there is a centrally located small diameter bore 38 (see FIG. 4). The small diameter counter-bore 38 extends diametrically across the longitudinal bore 12 to intersect with the shoulder 24 formed at the junction of counter bore 23 and the bore 12. The bore 38 is arranged to receive a wire lead 40 emanating from the battery 19*a* and having a flat contact portion 40*a* resting on the shoulder 24 and lying transversely across the diameter of the counter bore portion 23 of the bore 12. The housing 11 is preferably fabricated from acetyl or other non-conducting material.

Figure 4:
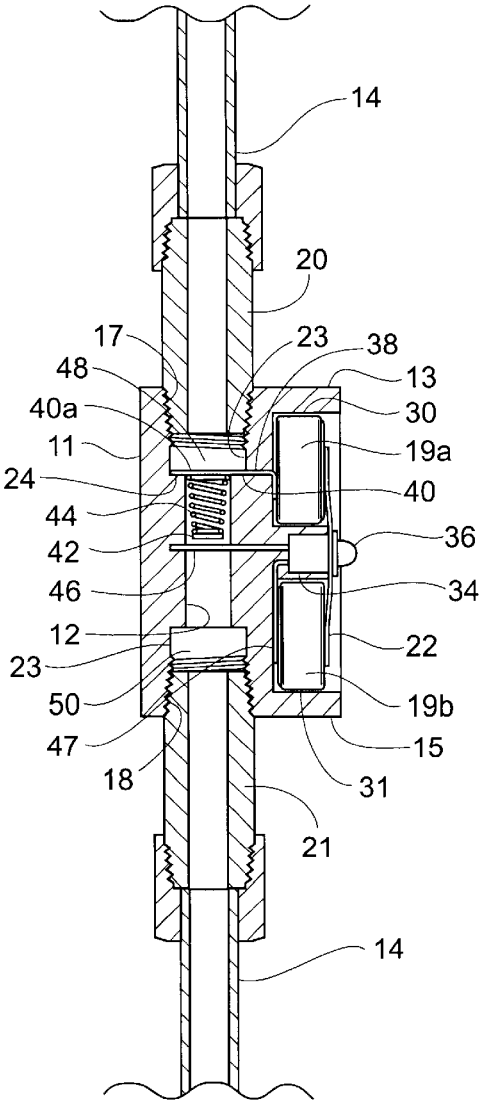
FIG. 4 is a cut-away side elevational view of the indicator with no fluid flowing.
Figure 5:
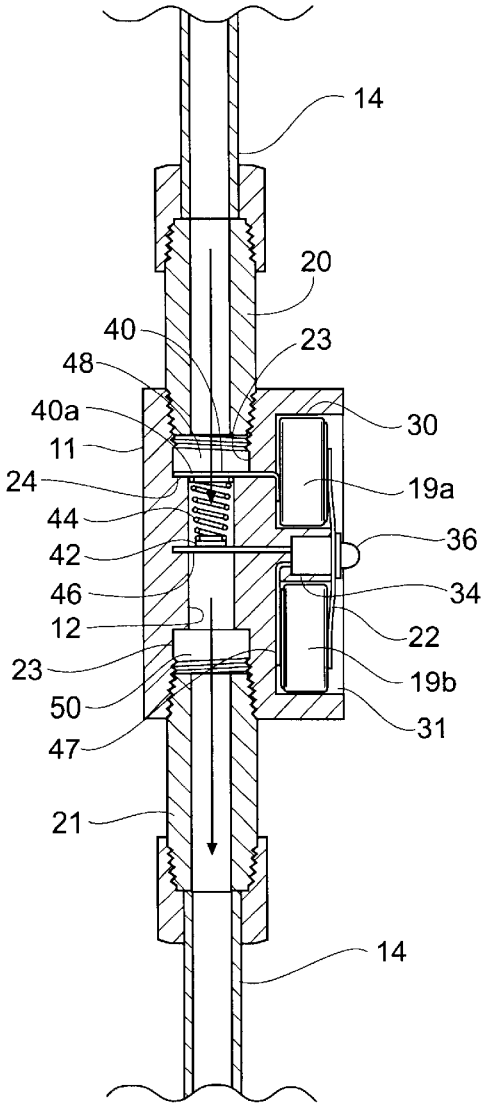
FIG. 5 is a cut-away side elevational view of the indicator during fluid flow.

A contact disk 42 is secured to a conical spring 44 and the assembly is inserted into the upper opening or fluid inlet end of the bore 12 in the housing 11. The disk 42 and spring 44 are preferably fabricated from brass and stainless steel, respectively. The electrically conductive wire battery lead 40 provides a stationary contact for electrically mating with the contact disk 42 through spring 44 during fluid flow pressing against the disk 42. The lead 40 is inserted within the bore 38 in the upper battery pocket 30, extending across the counter bore 23 to rest on the shoulder 24. The end of the push wire lead 40 is bent over allowing a battery 19*a* to be inserted into the battery pocket 30. The light emitting diode 36 has two leads 46, 47. Lead 46 is known as the anode and lead 47 is known as the cathode. The anode lead 46 is trimmed to a length of $^{21}/_{32}$ inches. The cathode lead 47 is trimmed to a length of $^{5}/_{16}$ inches and then bent at substantially right angle as shown in FIGS. 1, 4 and 5. The LED 36 is inserted into the LED counter bore 38. In a preferred embodiment ,the LED 36 is a high efficiency green at 45 degrees cone angle LED that is daylight visible.

The batteries 19*a* and 19*b* supply power to the indicator assembly 10. In the preferred embodiment, the batteries are conventional silver oxide button cell batteries having a predetermined power rating. Each battery 19*a*, 19*b* is placed into its respective battery pocket, or counterbore 30 and 31. The counter-bores 30 and 31 are each dimensionally contoured to accommodate a respective button cell battery 19*a* and 19*b*. An electrically conductive battery jumper tab 22 retains the batteries 19*a*, 19*b*. The tab 22 is placed over the batteries 19*a*, 19*b* and is retained by a pair of drive mounting studs 25 (See FIG. 2). The studs 25 engage with a friction fit into openings 27 formed in the housing 11. It should be noted that the tab 22 has a central opening 29 formed therein. The LED 36 passes through the central opening 29 when the tab or jumper 22 is installed.

Finally, a conventional, epoxy-based potting compound 49 is mixed and poured into the milled slot 26 and over the above-described components. Care must be taken to insure that the potting compound 49 does not coat the LED 36 or overflow from the slot 26. The potting compound 49 cures in approximately 12 hours, during which time the indicator assembly 10 should remain on a flat surface.

As best seen in FIGS. 4 and 5, the helical spring 44, push wire lead 40, contact disk 42, LED 36, batteries 19*a*, 19*b* and jumper tab 22 form an electrical circuit. The batteries 19*a*, 19*b* are connected in series by the jumper tab 22. The push wire lead 40 connects the upper battery 19*a* to one end of the helical spring 44. The helical spring 44, coupled to the contact disk 42 forms a switch in conjunction with lead wire 46 of the LED 36. The other lead wire 47 (cathode), emanating from LED 36, is connected to the other battery 19*b*. When the disk 42 contacts the anode lead 46 of the LED 36, the electrical circuit is closed thereby illuminating the LED 36. When the disk 42 retracts under the force of spring 44, the circuit is opened and the LED 36 is no longer illuminated.

Again referring to FIGS. 4 and 5, the indicator assembly 10 is installed between a fluid inlet 48 and a fluid outlet 50. Fluid flows under a predetermined pressure into the indicator 10 from a source, such as a PURGEX® metering pump, manufactured by OIL-RITE® CORPORATION of Manitowoc, Wis. As the fluid contacts the disk 42, the fluid pressure overcomes the resistance of the spring 44 attached to the disk 42. The disk 42 is displaced from its initial position to a second position where it contacts the lead wire 46 as shown in FIG. 5, thereby completing the electrical circuit. When the electrical circuit is closed, the LED 36 illuminates. As the pressure from the pulse of the fluid diminishes, the spring force overcomes the fluid force and the disk 14 moves back to its initial position as shown in FIG. 4. When the metering pump expels the next fluid pulse, the electrical circuit will be completed again and the LED 36 will be illuminated. The illuminated LED 36 provides a visual indication that fluid is flowing through the indicator assembly 10.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

What is claimed is:

1. A fluid flow indicator assembly for monitoring the flow of pressurized fluid through a conduit, said assembly comprising a self-contained unit including a housing having a longitudinal through bore extending from a fluid inlet end to a fluid outlet end of said housing;

said housing containing an electrical indicator circuit comprising a light emitting diode, a first and a second lead wire, each of said lead wires being axially spaced apart and each extending transversely across said longitudinal through bore, a battery power source for illuminating said diode and being, supported within said housing and being connected to said first lead wire, said second lead wire being connected to said diode, and a normally open electrical switch comprising a fluid pressure operated movable contact, said movable contact being axially movable within said bore and arranged to electrically contact said first lead wire responsive to fluid pressure exerted against said movable contact, and electrically conducting biasing means supporting and restraining said movable contact against movement towards said second lead wire extending across said bore.

2. The indicator assembly of claim 1 wherein said biasing means comprises a conically wound spring contained within said longitudinal bore, said spring having a first end supported from and in electrical connection with said first lead wire, and said movable contact being suspended from and in electrical connection with the opposite end of said spring, and said movable contact being axially movable against the bias of said spring under the influence of fluid flow in said longitudinal bore and towards electrical contact with said second lead wire to complete the electrical circuit for energization of said diode from said battery.

3. The indicator assembly of claim 1 wherein said housing includes a pocket defined by a counter-bore configured to receive a button cell battery.

4. The indicator assembly of claim 3 wherein said housing includes a pair of longitudinally spaced pockets, each pocket being defined by a counter-bore and being respectively configured to receive a pair of electrically connected button cell batteries.

5. The indicator assembly of claim 4 wherein the electrical connection for said button cell batteries comprises an overlying electrically conducting jumper tab, said tab further including fastener means for securing each of said batteries within a respective housing pocket.

6. The indicator assembly of claim 1 wherein said movable contact comprises a disk positioned in a plane intersecting the longitudinal axis of said longitudinal bore and having a diameter of sufficient dimension to be responsive to fluid flow in said longitudinal bore.

7. The indicator assembly of claim 5 wherein the batteries and jumper tab are covered with a cured layer of an electrical insulating potting compound.

8. A method of indicating fluid flow in a conduit containing fluid, said method comprising the steps of:

providing a housing having a through bore with a fluid inlet at one end and a fluid outlet at the opposite end of said bore:

providing laterally spaced stationary electrical conducting elements within said bore and a movable contact axially movable within said bore, said movable contact being in electrical connection with electrically conducting biasing means and being arranged to intercept fluid flow within said longitudinal bore, said biasing means being in electrical and mechanical connection with one of said stationary conducting elements arranged to conduct electrical current from one of said stationary conducting elements to the other of said elements to via said movable contact and further being arranged to bias said movable contact in an axial direction away from electrical connection with said other of said elements in the absence of fluid flow effecting closure of said movable contact with the other of said stationary contact elements;

counter-boring said housing to provide a receptacle for receiving a light-emitting diode arranged to indicate presence of fluid flow in said longitudinal bore, counter-boring said housing to provide a pocket for receiving at least one button cell battery, and providing electrical conducting leads for completing an electrical circuit from said battery to said diode responsive to fluid flow in said longitudinal bore.

9. The method of claim 8 including the step of counter-boring a pair of longitudinally spaced pockets for respectively receiving a pair of said button cell batteries, providing a jumper tab mechanically securing and electrically connecting said pair of batteries.

10. The method of claim 9 including the step of applying a curable electrically insulating composition to said housing contents including said batteries and said jumper tab, and curing said composition therein.

* * * * *